United States Patent [19]

Branson et al.

[11] 4,003,014

[45] Jan. 11, 1977

[54] REFRACTORY RESISTANCE TERMINAL

[75] Inventors: Charles D. Branson; William D. Long, Jr., both of Greensburg, Pa.

[73] Assignee: Robertshaw Controls Company, Richmond, Va.

[22] Filed: Sept. 25, 1975

[21] Appl. No.: 616,799

[52] U.S. Cl. ..... 338/326; 219/270; 338/329; 338/332; 339/275 T

[51] Int. Cl.[2] ..... H01C 1/14

[58] Field of Search ..... 219/270, 260, 264, 265, 219/266; 338/322, 326, 329, 332; 174/94 R; 339/275 R, 275 T

[56] References Cited

UNITED STATES PATENTS

| | | | |
|---|---|---|---|
| 1,189,235 | 7/1916 | Brown | 339/275 T |
| 1,255,059 | 1/1918 | Slick et al. | 339/275 T |
| 2,279,677 | 4/1942 | Heinrich | 174/94 R |

*Primary Examiner*—C. L. Albritton
*Attorney, Agent, or Firm*—O'Brien & Marks

[57] ABSTRACT

A sleeve of in-situ-solidified-from-melt material, such as a lead glass or the like, surrounds an end segment of a refractory resistance element extending from a junction between a metal supporting member and the end of the element. The solidified-from-melt material is formed not to adversely react with the refractory element and has a coefficient of linear expansion within the range from about 0.5 to 1.5 times the coefficient of linear expansion of the refractory material.

12 Claims, 4 Drawing Figures

FIG. 1
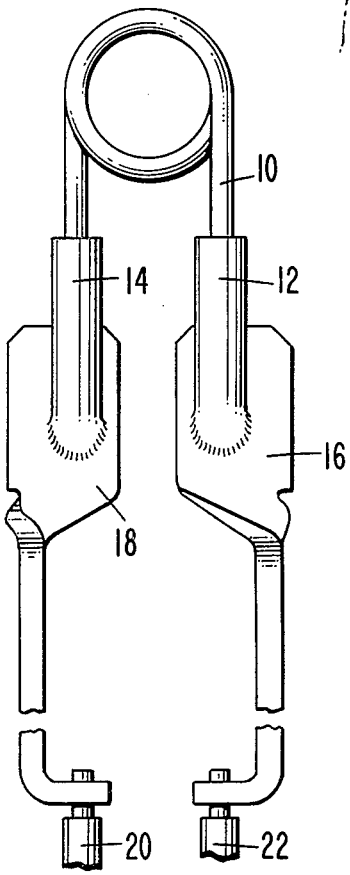
FIG. 2
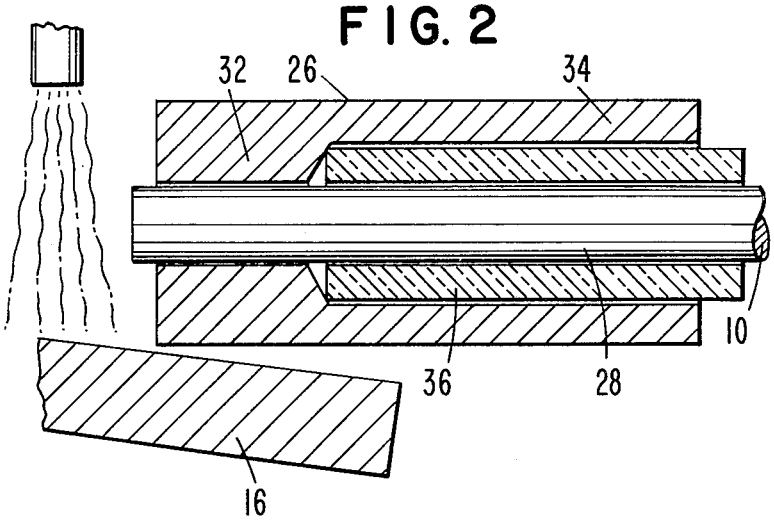
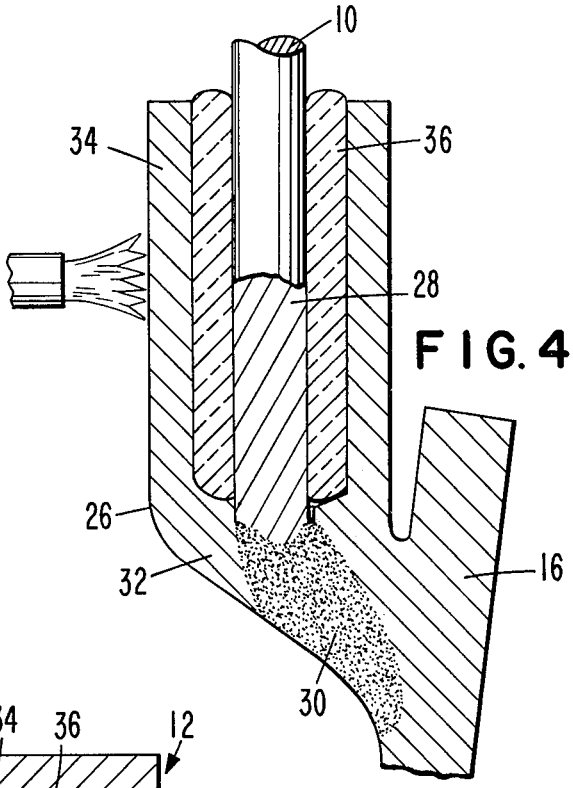
FIG. 4
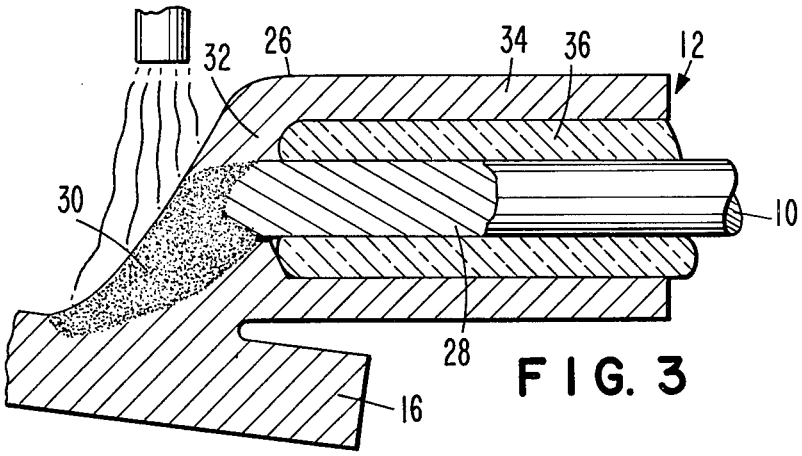
FIG. 3

REFRACTORY RESISTANCE TERMINAL

BACKGROUND OF THE INVENTION

1. Field of the Invention

The invention relates to electrical terminals for resistive elements, and in particular, to an electrical supporting terminal for high temperature element, such as a molybdenum disilicide resistance element used as an igniter or sensor for a flame.

2. Description of the Prior Art

Prior art terminals for high temperature or igniter elements including molybdenum disilicide elements, as exemplified in U.S. Pat. Nos. 895,857, 1,496,569, 2,384,797, 3,307,136, 3,522,574, 3,562,590, 3,569,787 and 3,662,222, have been made by crimping, brazing, soldering, welding, bonding or otherwise joining metal terminal members or sleeves to elements. Commerically available molybdenum disilicide elements containing minor portions of ceramics or other materials initially have substantial strength and ability to withstand shock. However many prior art terminals for molybdenum disilicide elements have been of limited suitability due to failure at or near the junction between the element and the terminal members during the joining process, handling shocks or repeated use; some of the failures result from rapid deterioration in strength and conductivity of the materials used in making the terminals or junctions. Welding the elements to heat-resistant metal terminals avoids failures due to rapid deterioration in strength and conductivity of the terminals; however, welding of molybdenum disilicide elements to commonly used heat-resistant metals has previously not been entirely satisfactory because the elements have tended to become weakened and embrittled at or near the welded junction tending to break during or after the welding process. It has been previously suggested that this weakening and embrittlement of molybdenum disilicide elements is caused by relatively large temperature gradients. Also some failures of molybdenum disilicide elements in welded junctions to heat resistance metal terminals have been attributed to the result of dissimilar temperature expansion coefficients and other incompatable metal properties. Provision of separate mechanical support for molybdenum disilicide elements eliminates some of the failures during subsequent handling; however, such provision has not been completely successful, and also failures still occur prior to providing the mechanical support.

One significant breakthrough in the formation of terminals on refractory resistance elements has been the employment of a metal supporting member, such as a sleeve, extending along a segment of a refractory resistance element with one end of the resistance element and supporting member fused together and with the unfused portion of the supporting member extending along a substantial portion of the segment providing mechanical support for the element where subject to weakening. Also this prior art refractory resistance and terminal included a layer of malleable metal, such as silver, interposed between the unfused portion of the supporting member and the segment of the element; such malleable metal including a solidified-from-melt portion which was melted during the fusing of the supporting member and the refractory resistance element and then cooled to surround and engage a portion of the segment of the element. This prior art refractory resistance and terminal is shown in U.S. Pat. No. 3,969,696 granted July 13, 1976.

Additionally, a number of techniques have been developed in the prior art to connect dissimilar metal members, such as conductors, tubes, etc., used in relatively low temperature applications as exemplified in U.S. Pat. Nos. 2,914,641, 3,244,798 and 3,656,092. Generally, such techniques are inapplicable or unsuitable for high temperature resistance elements, such as molybdenum disilicide elements, in that the materials employed are substantially deteriorated in strength and conductivity by high temperatures, air and fuel.

SUMMARY OF THE INVENTION

The invention may be summarized in that a resistance and terminal includes an elongated resistance element made from a conductive refractory material which is weakened where subjected to a substantial temperature gradient, a metal supporting member extending along a segment of the element from one end of the element and at least partially surrounding the segment of the element, a fused portion having constituents of the supporting member metal and the refractory material joining the one end of the resistance element to the supporting member, said supporting member having an unfused portion along a substantial portion of the segment providing mechanical support for the element where subject to weakening, and a layer of solidified-from-melt material interposed between the unfused portion and the segment of the element, said solidified-from-melt material selected to be compatable with the refractory element and having a coefficient of linear expansion within the range of about 0.5 to 1.5 times the coefficient of linear expansion of the refractory material.

An object of the invention is to construct a high temperature resistance element, such as a molybdenum disilicide element or the like, and an electrical terminal and support which can be subjected to repeated heating cycles over a long duration without failure.

Another object of the invention is to provide an elongated refractory resistance element with a terminal which electrically connects and mechanically supports the element where subject to weakening due to a temperature gradient near the terminal.

It is also an object of the invention to eliminate breakage or failure at or near the junction of a refractory resistance element and terminal.

One advantage of the invention is that it makes possible the manufacture and employment of a more practical and longer lasting electrical igniter for fluid fuel burners.

A feature of the invention is the provision of a layer of compatable glass interposed between an end segment of a refractory resistance element and a mechanical supporting portion of a metal terminal to eliminate breakage and degradation of the refractory resistance element.

Other objects, advantages and features of the present invention will be apparent from the following description of the preferred embodiment taken in conjunction with the accompanying drawings.

BRIEF DESCRIPTION OF THE DRAWINGS

FIG. 1 is a plan view of an electrical resistance device in accordance with the invention.

FIG. 2 is a detail side view in cross section illustrating the manufacture of one of the terminals on the resistance element of the device of FIG. 1.

FIG. 3 is a detail side view in cross section illustrating a completed terminal of the resistance element of FIGS. 1 and 2.

FIG. 4 is a detail cross sectional view showing a modified electrical resistance element and terminal in accordance with the invention.

DESCRIPTION OF THE PREFERRED EMBODIMENT

The term "metal" as used herein includes all elements, compounds and mixtures or alloys thereof which may be fused and used as conductors of electricity and heat. The term "glass" as used herein includes all compounds or mixtures which do not have a relatively specific melting point or a significant heat of transformation when passing from a liquid phase to a solid phase or vice versa.

As illustrated in FIG. 1, the present invention is embodied in an electrical resistance device which has an elongated electrical resistance element 10, with substantially identical supporting terminals 12 and 14 joined to similar metal terminal strips 16 and 18 which are connected to electrical wires 20 and 22.

The electrical resistance element 10 is made from an electrical refractory resistance material such as molybdenum disilicide mixed with minor portions of ceramics or other materials, such molybdenum disilicide elements being commerically available.

As shown in FIG. 3 the terminal 12 includes a sleeve 26 of high temperature or heat resistant metal over a segment 28 at one end of the element 10 with one end of the sleeve joined to the one end of the element such as by the fused portion 30 having constituents of the heat resistant metal and the refractory resistance material of element 10. A portion 32 of the sleeve 26 adjacent its one end has inside cross-sectional dimensions only slightly larger than the cross-sectional dimensions of the segment 28 of the element 10, while a portion 34 of the sleeve 26 toward the other end of the sleeve 26 and extending over the segment 28 of the element 10 has enlarged inside cross-sectional dimensions sufficient to receive a solidified-from-melt material, such as a glass sleeve 36, interposed between the portion 34 of the sleeve 28 and the element 10.

Although the sleeve 26 is illustrated as having a round tubular configuration surrounding the outside surface of the element 10, other configurations of sleeves such as a longitudinally slit sleeve, or support members extending along the segment 28 and only partially surrounding the element 10 can be employed with equal success. Sleeves circumscribing more than 180° of the cross-sectional circumference of the element 10 provides maximum mechanical support against lateral stress.

The heat resistant metal of the sleeve 26 is selected for its strength and its ability to withstand high temperatures preferably up to or greater than about 840° C in air without any substantial deterioration of its strength or its conductive properties. Generally, suitable heat resistant metals can be selected from the chromium-steel alloys commonly referred to as stainless steels, such as stainless steel type 446 containing from about 23 to 30% chromium and about 0.35% carbon with the rest iron and other minor constituents or type 18SR stainless steel from ARMCO Steel Corporation.

The solidified-from-melt material is selected for its comptability with the refractory resistance material of the element 10. Preferably the solidified-from-melt material is formed from a glass. A glass containing silicon, lead, sodium and potassium oxides, such as glass material no. 0120 from Corning Glass Works has been found to be particularly suitable for molybdenum disilicide elements. Some materials are incompatable with the refractory resistance material when subjected to a great number of repeated heating cycles; for example silver and one boron oxide containing glass sold under the trademark Pyrex from Corning Glass Works were found deficient in that excessive numbers of elements broke during repeated heating cycles. Such incompatable materials are believed to react or abrade with the protective oxide layer, such as silicon dioxide layer on molybdenum disilicide, which forms to protect the element from attack by air, fuel products and the like during use; thus the refractory resistance material is left exposed to react with the fuel products and air reducing the mechanical support by the sleeves 26 and 36 or otherwise deteriorating the element 10 within the segment 28 adjacent the fused portion 30 to result in breakage.

Generally, it is desirable for the solidified from-melt material to have a coefficient of expansion which is within the range from about 0.5 to 1.5 times the coefficient of linear expansion of the refractory resistance material. Preferably this range is from about 0.8 to 1.2 times the coefficient of linear expansion of the refractory resistance material. The best results are achieved when the coefficient of linear expansion of the solidified-from-melt material is greater than the coefficient of linear expansion of the refractory resistance material but less than about 1.2 times the coefficient of linear expansion of the refractory material. Also the coefficient of linear expansion of the supporting member is selected to be slightly greater than the coefficient of linear expansion of the solidified-from-melt material. By having the coefficients of expansion of the three materials slightly different with the refractory material 10 having the lowest coefficient of linear expansion, the solidified-from-melt material having a slightly higher coefficient of linear expansion and the supporting member having a still slightly higher coefficient of linear expansion, the actual expansion in each of the refractory resistance material, the solidified-from-melt material, and the supporting member metal is substantially the same during use since the largest temperature change occurs in the refractory resistance material, the next largest change occurs in the solidified-from-melt material and the lowest temperature change occurs in the supporting member.

The terminal strip 16 is made from a heat resistant metal which can be the same metal as the sleeve 26. As shown in FIG. 1 the strip 16 has a length extending from the terminal 12 which is designed to dissipate the heat from the terminal 12 to prevent excessively heating the junction of the wire 20 and the strip 16. The strip 16 is attached to the wire 20 by a convention crimping or bonding operation. The wire 20 is typically a high temperature insulated multistrand copper conductor.

FIG. 2 illustrates the manufacture of the terminal 12 of the element 10. The sleeve 34 is first formed in a conventional manner, such as cutting from tubular stock, rolling from a flat stock or the like, and then is positioned over the end of the element 10 together with a tubular piece of glass 36 within the portion 34 of the sleeve 26. Intense heat such as a needle plasma arc is applied to the strip 16 to preheat the strip 16, and then is applied to the end of the sleeve 26 and to the end of the element 10, as shown in FIG. 3, to form the fused portion 30 from the sleeve 26 and the element 10 as shown in FIG. 2. Also the heat melts the glass tube 36 in situ within the sleeve 26 which due to capillary forces remains within the bore of the portion 34 of the sleeve 26 and flows around the segment 28 of the element filling the space between the sleeve 26 and the segment 28. After fusing, the electric heat is turned off to allow the terminal 12 to cool in room atmosphere to prevent any large temperature gradiant in the element 10 beyond the segment 28 supported by the solidified-from-melt material 36.

In employing the refractory resistance device shown in FIG. 1 as an igniter or sensor for a flame, the device is suitably installed and current is applied from a source (not shown) through the wires 20 and 22, metal strips 16 and 18, terminals 12 and 14 and the element 10. Generally elements such as molybdenum disilicide have resistance characterictics which increase or decrease with changes in temperatures. Relatively small currents are used through the element 10 to sense the resistance characteristic and determine the temperature while large currents are employed to heat the resistance element 10 to a temperature sufficient to ignite fuels.

When handling or installing a resistance device the support for the element 10 given by the sleeve 26 and the solidified-from-melt material 36 substantially reduces breakage of the element 10 from shock or stress. In use as an igniter, current through the element 10 heats the coil of the element 10 to a temperature in the range from about 1010° C to 1349° C exposing the terminals to a temperature of about 788° C resulting in a relatively large temperature gradiant in the end segment 28 of the element 10 where any weakening of the element 10 is supported by the terminals 12 and 14. The fused portion 30 forms a good conductive connection between the element 10 and the heat resistant metal of the sleeve 26 which is not substantially deteriated by prolonged exposure to high temperatures. During use, stress is prevented by having the temperature coefficient of the solidified-from-melt material 36 being within about 0.5 to 1.5 times the coefficient of temperature expansion of the element 10.

In the modification shown in FIG. 4, a terminal made in accordance with the terminal 12 shown in FIGS. 1–3 is subjected to a further step wherein the sleeve 26 is oriented to a vertical position and heat is applied to the sleeve 26 by a torch, induction coil, or other means to heat the sleeve 26 to the melting temperature of the solidified-from-melt material 26 but less than the melting temperatures of the sleeve 34 and the element 10 to form a more uniform potting of the solidified from-melt material in the exposed open end of the sleeve 26 around the element 10.

Since many variations, modifications, and changes in detail can be made to the present embodiments, it is intended that all matter contained in the foregoing description and shown in the accompanying drawings shall be interpreted as illustrative and not in a limiting sense.

What is claimed is:

1. A resistance and terminal comprising an elongated resistance element made from a conductive refractory material which is weakened where subjected to a substantial temperature gradient, a metal supporting member extending along a segment of the element from one end of the element and at least partially surrounding the segment of the element, a fused portion having constituents of the supporting member metal and the refractory material joining the one end of the resistant element to the supporting member, said supporting member having an unfused portion along a substantial portion of the segment providing mechanical support for the element where subject to weakening, and a layer of solidified-from-melt material interposed between the unfused portion and the segment of the element, said solidified-from-melt material selected to be compatable with the refractory element and having a coefficient of linear expansion within the range of about 0.5 to 1.5 times the coefficient of linear expansion of the refractory material.

2. A resistance and terminal as claimed in claim 1 wherein the solidified-from-melt material has a coefficient of linear expansion within the range of about 0.8 to about 1.2 times the coefficient of linear expansion of the refractory material.

3. A resistance and terminal as claimed in claim 2 wherein the solidified-from-melt material has a coefficient of linear expansion which is greater than the coefficient of linear expansion of the refractory material, and the metal of the supporting member has a coefficient of linear expansion which is slightly greater than the coefficient of linear expansion of the solidified-from-melt material.

4. A resistance and terminal as claimed in claim 1 wherein the layer of solidified-from-melt material is a glass.

5. A resistance and terminal as claimed in claim 4 wherein the glass contains silicon, potassium, sodium and lead oxides.

6. A resistance and terminal as claimed in claim 4 wherein the refractory material is principally molybdenum disilicide, and the supporting member is an alloy containing chromium and steel.

7. A resistance and terminal comprising an elongated resistance element made from a conductive refractory material, a metal terminal member fused with one end of the resistance element, a glass sleeve surrounding a segment of the elongated resistance element contiguous with the metal terminal member, and said glass sleeve formed from a glass compatable with said refractory material.

8. A resistance and terminal as claimed in claim 7 wherein said conductive refractory material includes a principal portion of molybdenum disilicide, and said glass sleeve contains silicon, lead, potassium and sodium oxides.

9. A resistance and terminal comprising an elongated resistance element made from a conductive refractory material, a metal supporting and electrical connecting member including a metal sleeve telescoped over a segment of the element at one end of the element, said metal sleeve having a first portion adjacent its one end with first inside cross-sectional dimensions slightly larger than the cross-sectional dimensions of the element, said first portion of the metal sleeve and said one end of the element being joined together, said metal sleeve having a second portion with enlarged inside cross-sectional dimensions toward its other end over the segment of the element, a glass sleeve disposed inside the second portion of the metal sleeve and in engagement with the segment of the element, and said glass sleeve formed from a glass compatable with the refractory material.

10. A resistance and terminal as claimed in claim 9 wherein said glass sleeve is solidified from a melt in situ within the second portion of the metal sleeve.

11. A resistance and terminal as claimed in claim 10 including a fused portion having constituents of the metal sleeve and the refractory material joining the one end of the resistance element to the portion of the metal sleeve.

12. A resistance and terminal as claimed in claim 11 wherein said metal sleeve is an alloy containing steel and chromium, said element contains a principal portion of molybdenum disilicide, and said glass contains silicon, lead, sodium and potassium oxides.

* * * * *